US011439216B2

(12) United States Patent
Antonakou et al.

(10) Patent No.: US 11,439,216 B2
(45) Date of Patent: Sep. 13, 2022

(54) SMART DISPENSER SYSTEM AND METHODS OF USE

(71) Applicant: BIC VIOLEX S.A., Anixi (GR)

(72) Inventors: Alexandra Antonakou, Athens (GR); Panagiotis Moustakas, Athens (GR); Georgia Tsoukleri, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 119 days.

(21) Appl. No.: 16/622,430

(22) PCT Filed: Jun. 1, 2018

(86) PCT No.: PCT/EP2018/064449
§ 371 (c)(1),
(2) Date: Dec. 13, 2019

(87) PCT Pub. No.: WO2019/001895
PCT Pub. Date: Jan. 3, 2019

(65) Prior Publication Data

US 2020/0107626 A1 Apr. 9, 2020

Related U.S. Application Data

(60) Provisional application No. 62/526,687, filed on Jun. 29, 2017.

(51) Int. Cl.
*A45D 27/22* (2006.01)
*B26B 21/40* (2006.01)

(52) U.S. Cl.
CPC ..... *A45D 27/225* (2013.01); *B26B 21/405* (2013.01)

(58) Field of Classification Search
CPC .. A45D 27/225; B26B 21/405; B26B 21/4056
See application file for complete search history.

(56) References Cited

U.S. PATENT DOCUMENTS 4,034,892 A 7/1977 Braginetz
4,660,991 A * 4/1987 Simon ..... G04B 37/127 368/10

(Continued)

FOREIGN PATENT DOCUMENTS

CN 1442819 A 9/2003
CN 1685289 A 10/2005

(Continued)

OTHER PUBLICATIONS

International Search Report in corresponding Application No. PCT/EP2018/064449, dated Aug. 13, 2018, (3 pages).

(Continued)

*Primary Examiner* — Gene O Crawford
*Assistant Examiner* — Kelvin L Randall, Jr.
(74) *Attorney, Agent, or Firm* — Bookoff McAndrews, PLLC

(57) ABSTRACT

A shaving system including a dispenser having a plurality of slots, a first of which is configured to releasably receive a cartridge having at least one razor blade. An electrical circuit associated with the first slot including first and second electrically conductive elements, which are spaced apart from one another to form a gap therebetween. The electrical circuit is configured to switch between an open configuration in which the gap is unbridged and a closed configuration in which an electrically conductive material spans the gap, electrically connecting the first and second electrically conductive elements. The system is configured to detect removal of a first cartridge from the first slot based on whether the electrical circuit is in the open or the closed configuration. The system is configured to generate a signal when removal of the first cartridge is detected.

16 Claims, 13 Drawing Sheets

(56) References Cited

U.S. PATENT DOCUMENTS

| | | | | |
|---|---|---|---|---|
| 5,240,107 | A | 8/1993 | Casale | |
| 5,752,235 | A * | 5/1998 | Kehr | G08B 21/24 702/177 |
| 5,812,064 | A * | 9/1998 | Barbour | A61J 1/03 340/5.91 |
| 6,168,023 | B1 * | 1/2001 | Cooper | A45D 27/22 132/290 |
| 6,263,259 | B1 * | 7/2001 | Bartur | G07F 5/18 700/242 |
| 6,348,864 | B1 * | 2/2002 | Lin | G07C 9/38 340/570 |
| 8,646,467 | B2 * | 2/2014 | Lelieveld | B26B 21/40 132/289 |
| 9,043,015 | B2 * | 5/2015 | Ratnakar | A61J 7/0445 700/241 |
| 2002/0027507 | A1 * | 3/2002 | Yarin | G07G 1/0045 340/573.1 |
| 2002/0184770 | A1 | 12/2002 | Peyser | |
| 2003/0071725 | A1 * | 4/2003 | Teller | G06Q 20/203 340/568.1 |
| 2006/0058917 | A1 * | 3/2006 | Vonk | A61J 7/0481 700/236 |
| 2007/0050983 | A1 | 3/2007 | Schnak et al. | |
| 2009/0071008 | A1 | 3/2009 | Hart et al. | |
| 2012/0203376 | A1 * | 8/2012 | Savage | B25H 3/00 700/214 |
| 2013/0213995 | A1 * | 8/2013 | Horel | A47K 10/44 221/197 |
| 2014/0214200 | A1 * | 7/2014 | Chrusciel | A61J 7/0076 700/237 |
| 2014/0350720 | A1 * | 11/2014 | Lehmann | A61J 7/0481 700/236 |
| 2015/0314023 | A1 * | 11/2015 | New | A61L 2/08 422/22 |
| 2016/0015602 | A1 * | 1/2016 | Panzini | G16H 20/10 340/666 |
| 2016/0167241 | A1 | 6/2016 | Goldfarb et al. | |
| 2017/0066147 | A1 | 3/2017 | Ball et al. | |
| 2017/0193189 | A1 * | 7/2017 | Turnell | A61J 7/0427 |

FOREIGN PATENT DOCUMENTS

| | | | |
|---|---|---|---|
| CN | 1807071 | A | 7/2006 |
| CN | 1929970 | B | 4/2012 |
| EP | 1252981 | A1 | 10/2002 |
| JP | H02-223398 | A | 9/1990 |
| JP | H07-35036 | U | 6/1995 |
| JP | H10-314466 | A | 12/1998 |
| JP | 2008-537503 | A | 9/2008 |
| JP | 2009-506823 | A | 2/2009 |
| JP | 2010-538693 | A | 12/2010 |
| JP | 2015-064846 | A | 4/2015 |
| WO | 2006108126 | A1 | 10/2006 |
| WO | 2011070486 | A1 | 6/2011 |

OTHER PUBLICATIONS

Chinese Office Action in corresponding Chinese Application No. 201880031083.7, dated Jan. 25, 2022 (27 pages).

Office Action and Search Report in corresponding JP Application No. 2019-565213, dated May 18, 2022 (35 pages).

* cited by examiner

SMART DISPENSER SYSTEM AND METHODS OF USE

CROSS-REFERENCE TO RELATED APPLICATIONS

This application is a National Stage Application of International Application No. PCT/EP2018/064449, filed Jun. 1, 2018, now published as WO2019001895, and which claims the benefit of U.S. Provisional Application No. 62/526,687, filed Jun. 29, 2017.

TECHNICAL FIELD

Various aspects of the present disclosure relate generally to embodiments of systems and methods for a smart dispenser system. More particularly, the present disclosure describes embodiments of systems and methods for monitoring razor cartridges in a dispenser system, the use of those razor cartridges, and refilling or otherwise replenishing used razor cartridges or razor cartridges otherwise removed from the dispenser system.

DESCRIPTION OF RELATED TECHNOLOGY

Typical shavers include a handle and a razor cartridge, with the razor cartridge including at least one blade configured to shave hair. After a certain number of uses, the razor cartridge blades may, e.g., become dull or otherwise unsuitable for continued shaving, and the cartridge may be discarded and replaced with another cartridge (e.g., a new cartridge) having relatively sharp or otherwise unused blades. The replacement cartridge may be provided in a dispenser or tray. Even though it is common knowledge that a razor cartridge has a certain usage lifetime, most users do not carefully track their razor cartridge usage, especially since the usage lifetime may vary by user based on, e.g., the shaving habits of a user and/or the characteristics of the hair of a user (e.g., thickness, coarseness, density, etc.). As a result, cartridges with blade(s) that are still sufficiently sharp for comfortably obtaining a good shave may often be discarded prematurely, or cartridges that are too dull may continue to be used, albeit with potentially reduced comfort, less than desirable results, or both. Moreover, razor cartridges often are packaged and sold in dispensers, with the dispensers containing anywhere from at least two to a multitude of razor cartridges, for example, ten razor cartridges. After a user has used and discarded the last razor cartridge in the dispenser, the user must then purchase an additional dispenser of razor cartridges.

Both the foregoing general description and the following detailed description are exemplary and explanatory only and are not restrictive of the features, as claimed. As used herein, the terms "comprises," "comprising," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." Further, the terms "first," "second," and so on are used herein to refer to an exemplary object in a group of one or more objects and are not used to denote numeric order, relative location, or superiority within that group of objects, unless otherwise specified. It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges means the value, limit, and/or range +/−10%.

SUMMARY OF THE DISCLOSURE

A shaving system may include a dispenser including a plurality of slots, a first of which may be configured to releasably receive a cartridge having at least one razor blade. An electrical circuit associated with the first slot may include first and second electrically conductive elements, which may be spaced apart from one another to form a gap therebetween. The electrical circuit may be configured to switch between an open configuration in which the gap is unbridged and a closed configuration in which an electrically conductive material spans the gap, electrically connecting the first and second electrically conductive elements. The system may be configured to detect removal of a first cartridge from the first slot based on whether the electrical circuit is in the open or the closed configuration. The system may generate a signal when removal of the first cartridge is detected.

Various embodiments of the system may include one or more of the following features. The signal may be configured for transmission to a third party. The signal may be a request for delivery of at least one new cartridge. The system may also include a push button, and depressing or releasing the push button may switch the electrical circuit between the first configuration and the second configuration. The first slot may contain a cartridge therein. At least a portion of the cartridge contained within the first slot may span the gap between the first electrically conductive element and the second electrically conductive element, electrically connecting the first electrically conductive element and the second electrically conductive element and placing the electrical circuit in the closed configuration. The cartridge may include a protective film, and the protective film may be configured to electrically connect the first electrically conductive element and the second electrically conductive element. Presence of the cartridge within the first slot may switch the electrical circuit into the open configuration. The system may also include a docking station configured to receive the dispenser, wherein the electrical circuit is included as part of the docking station.

Embodiments of the present disclosure may also be drawn to a shaving system. The shaving system may include a dispenser including at least one slot, wherein each of the at least one slots is configured to releasably receive a cartridge including at least one blade, and at least one cartridge positioned in the at least one slot. The system may be configured to detect a removal of the at least one cartridge from the at least one slot, and in response to detecting the removal, the system may be configured to generate a signal for transmission to a third party.

Various embodiments of the system may include one or more of the following features. At least one conductive element may be configured to engage a corresponding conductive element of the at least one cartridge when the at least one cartridge is positioned within the at least one slot. The system may be configured to detect the removal of the at least one cartridge from the at least one slot by detecting when the at least one conductive element disengages from the corresponding conductive element on the at least one cartridge. The corresponding conductive element on the at least one cartridge may include a protective film, and the protective film may be configured to electrically couple to the at least one conductive element. The system may also include at least one electrical circuit, wherein the at least one electrical circuit is configured to switch between an open configuration and a closed configuration, and wherein presence of the cartridge within the first slot switches the electrical circuit into the open configuration. The system may also include at least one electrical circuit, wherein the at least one electrical circuit is configured to switch between an open configuration and a closed configuration, and wherein the system is configured to detect removal of at least one cartridge from at least one of the plurality of slots based on whether the at least one electrical circuit is in the open configuration or the closed configuration. The system may further include a docking station configured to receive the dispenser, wherein the at least one electrical circuit is included as part of the docking station. The system may further include at least one proximity sensor, and the system may be configured to detect the removal of the at least one cartridge from the at least one slot using the at least one proximity sensor. The signal may be a request for delivery of at least one additional cartridge.

Another embodiment of the present disclosure may be drawn to a method of ordering a replacement razor cartridge. The method may include detecting removal of a razor cartridge from a dispenser. Upon detecting the removal of the razor cartridge from the dispenser, the method may include initiating an order for at least one replacement razor cartridge.

Various embodiments of the system may include one or more of the following features. Detecting the removal of the razor cartridge from the dispenser may include at least one of: (i) detecting whether at least one circuit associated with the dispenser is in an open configuration or a closed configuration, or (ii) detecting whether the razor cartridge is within proximity of at least one proximity sensor associated with the dispenser. Initiating the order for the at least one replacement razor cartridge may include generating a signal and transmitting the signal. Initiating the order for at least one replacement razor cartridge may include initiating an order for a replacement dispenser containing a plurality of replacement razor cartridges.

BRIEF DESCRIPTION OF THE DRAWINGS

The accompanying drawings, which are incorporated in and constitute a part of this specification, illustrate various exemplary embodiments and together with the description, serve to explain the principles of the disclosure. There are many aspects and embodiments described herein. Those of ordinary skill in the art will readily recognize that the features of a particular aspect or embodiment may be used in conjunction with the features of any or all of the other aspects or embodiments described in this disclosure.

DETAILED DESCRIPTION

Examples of the present disclosure include systems and methods to facilitate razor cartridge usage and/or ordering. For example, aspects of the present disclosure may provide a user with the ability to more easily identify degradation of a razor cartridge and more simply obtain replacement razor cartridges to, e.g., continue shaving without additional human intervention to purchase or otherwise procure replacement cartridges. More specifically, certain aspects of the present disclosure describe a smart razor cartridge refill system and method configured to automatically order replacement razor cartridges via the internet from an e-commerce business without user intervention or with minimal user intervention.

Reference now will be made in detail to examples of the present disclosure described above and illustrated in the accompanying drawings. Wherever possible, the same reference numbers will be used throughout the drawings to refer to the same or like parts.

Figure 1:
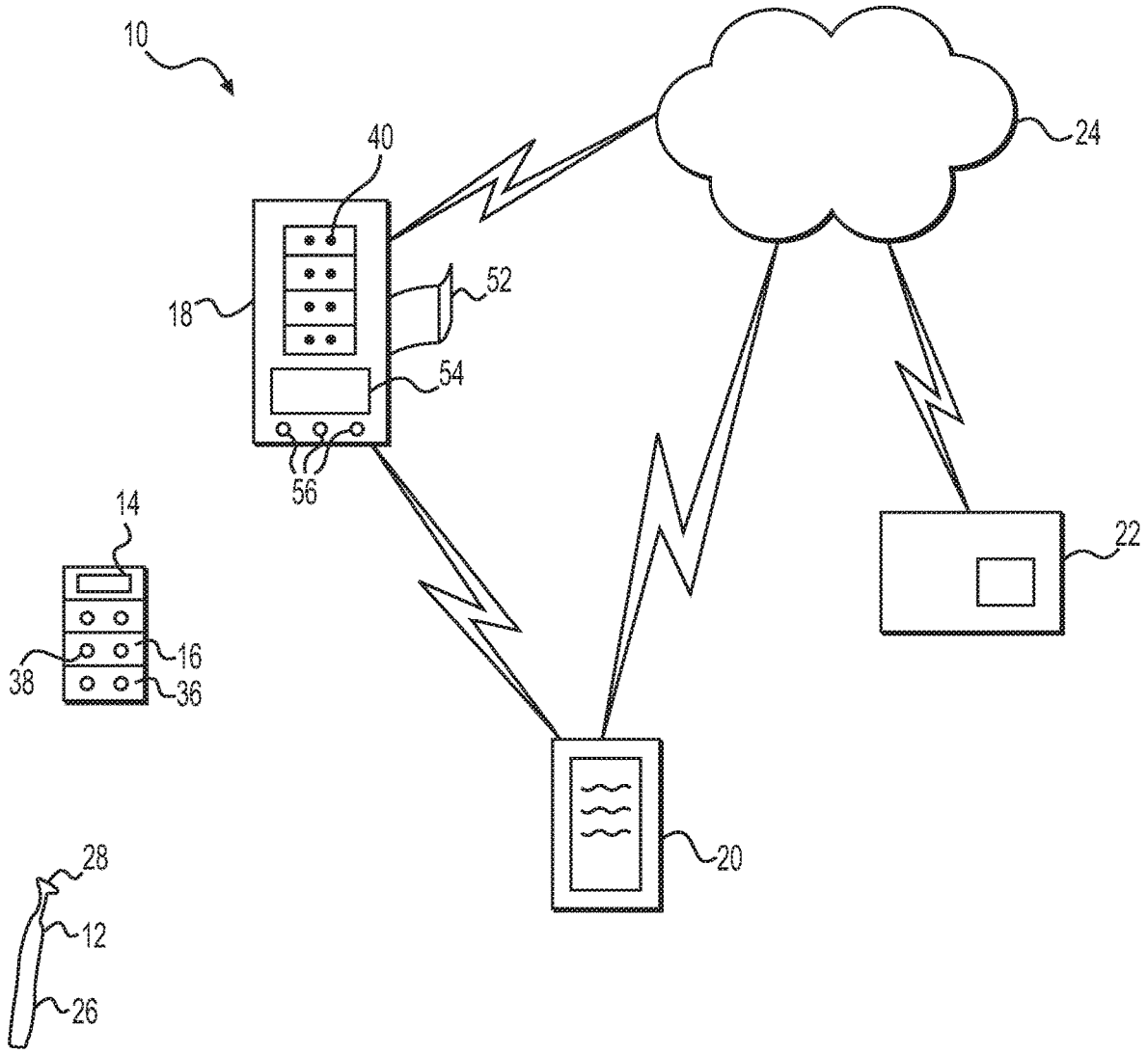
FIG. 1 illustrates an exemplary smart shaver system, including a dispenser for razor cartridges, according to aspects of the present disclosure.

According to aspects, as detailed in FIG. 1, a system 10 includes a handle 12, at least one cartridge 14, a dispenser 16 configured to retain the cartridge 14, and a docking station 18. The system 10 may also include a user device 20 configured to transmit and receive information to and from the docking station 18 and a third party or resource such as a merchant unit 22 via the internet 24. The docking station 18, user device 20, and merchant unit 22 may each be configured to receive, transmit, or receive and transmit data signals through wired or wireless connections such as, for example, through the internet 24 or Bluetooth™.

The handle 12 may include a handle body 26 configured to be held by a user. The handle body 26 may include any suitable configuration to promote comfortable gripping by a user. For example, the handle body 26 may include coatings or coverings such as a rubber covering, or may contain geometric features to prevent the handle 12 from slipping within a hand of the user especially when the handle 12 may be wet. The handle 12 may also include a handle attachment interface 28 at one end of handle body 26. The handle attachment interface 28 may be configured to selectively attach and release the cartridge 14 to/from the handle 12 through any mechanism known for attaching and releasing a disposable cartridge with a shaving handle.

Figure 2A:
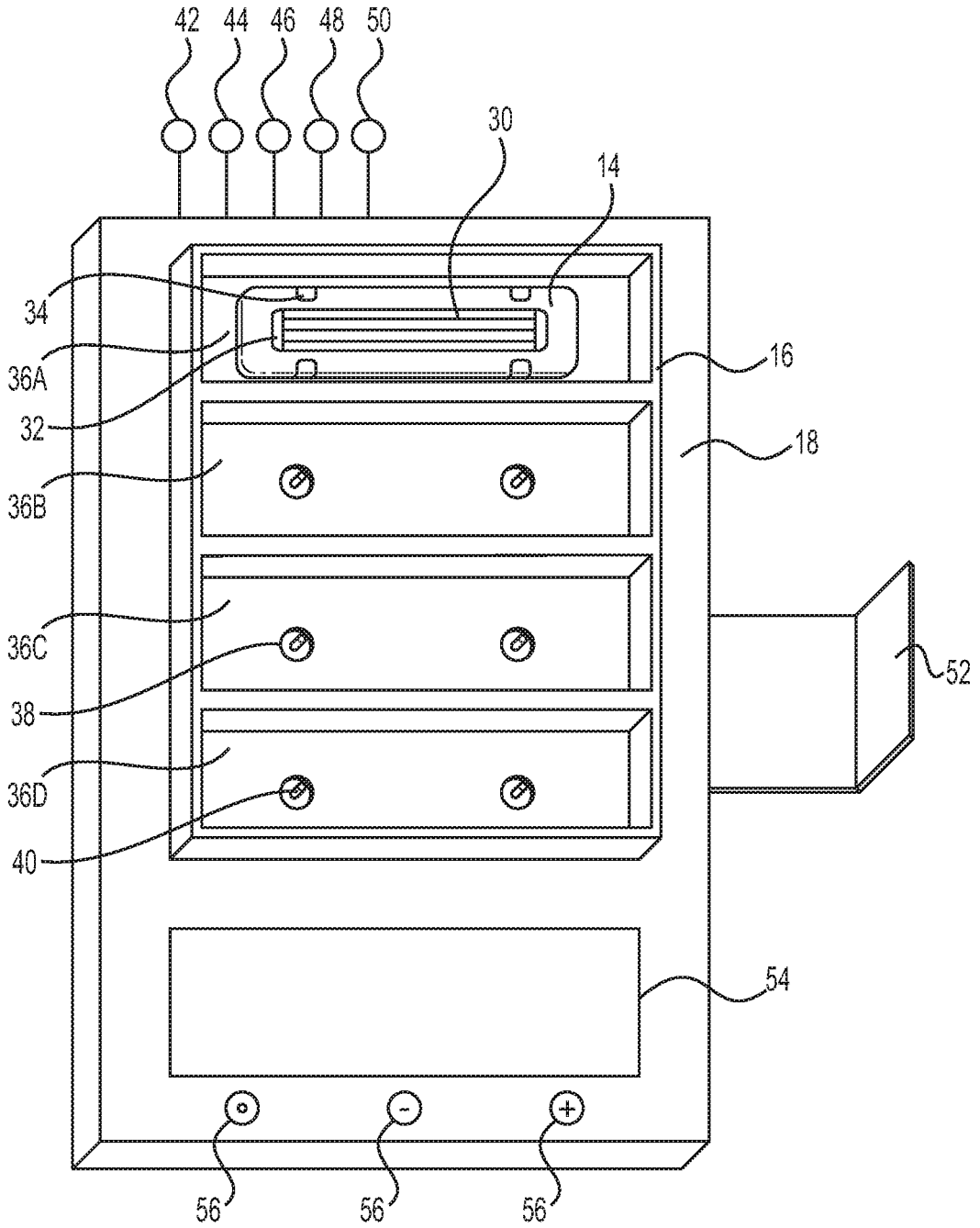
FIGS. 2A and 2B illustrate arrangements of a docking station, a dispenser, and a razor cartridge, according to aspects of the present disclosure.

According to further aspects, as shown in FIG. 2A, the cartridge 14 may be received or otherwise stored in the dispenser 16. The dispenser 16 will be described in greater detail below. The cartridge 14 may include any number of razor blades 30, which may include a trimmer blade (not shown). As discussed in more detail below, the cartridge 14 may include blade securing elements 32 that secure the razor blades 30 in the cartridge 14. The blade securing elements 32 may be conductive or may be insulating. Blade securing elements 32 may be insulated by, e.g., a coating such as polytetrafluoroethylene. According to some aspects, the cartridge 14 may include an additional conductive element (not shown) configured to electrically connect conductive elements in the docking station 18, as discussed in more detail below. Moreover, razor blades 30 may be conductive or may be insulating. The cartridge 14 may also include a handle coupling portion 34 configured to releasably engage handle attachment interface 28 such that the cartridge 14 may be selectively coupled to and released from the handle 12.

According to some aspects, the dispenser 16 and docking station 18 may be separate elements, as shown in FIG. 1. The docking station 18 may receive the dispenser 16, as shown in FIG. 2A. However, according to further aspects, the dispenser 16 and docking station 18 may instead be made an integral one-piece construction. It is noted that any discussion herein referring to the dispenser 16 and docking station 18 as separate elements equally applies to arrangements where the dispenser 16 and docking station 18 are constructed as a single unit via a one-piece construction, or where the dispenser 16 and docking station 18 are constructed as discrete components physically connected together, regardless of whether such connection is permanent or releasable. According to some aspects, the docking station 18 and dispenser 16 may be physically separated from one another, but operatively coupled together for the purposes of receiving and/or transmitting data such as, for example, via a wired or wireless interface. As such, the docking station 18 and dispenser 16 may be provided with suitable electronics and interfaces to facilitate the reception and transmission of data.

The dispenser 16 may include a plurality of slots 36 (e.g., slots 36A-36D), wherein each slot 36 may receive a cartridge 14. For example, the dispenser 16 may include four slots 36 to hold four cartridges 14. Although four slots 36 are depicted in FIG. 2A, those of ordinary skill in the art will understand that the dispenser 16 may include a greater or lesser number of slots 36. According to some aspects, the dispenser 16 may include a number of slots 36 equal to a number of cartridges 14 stored in the dispenser 16. According to other aspects, the dispenser 16 may include a number of slots 36 greater than or less than the number of cartridges 14 stored in the dispenser 16. For example, the dispenser 16 may include five cartridges 14 and six slots 36, one additional slot 36 so that a user may store a used cartridge 14 in the dispenser 16 before removing one of the other five cartridges 14.

The slots 36 may be any suitable shape configured to receive a particular type of cartridge 14. Alternatively, slots 36 may be a generic shape such that slots 36 may be configured to receive multiple types of cartridges 14. Moreover, slots 36 may include a biasing, a snap-fit, and/or a sliding configuration in order to securely retain the cartridges 14 before the cartridges 14 are removed by a user from the dispenser 16. The biasing, snap-fit, and/or sliding configurations may prevent the cartridges 14 from inadvertently falling out of the dispenser 16, such as, for example, during shipping or if the dispenser falls off a bathroom counter. According to some aspects, where the dispenser 16 and docking station 18 may be separate elements, the dispenser 16 may include openings 38 within slots 36 beneath the cartridges 14. The openings 38 may include any suitable configuration, shape, and/or dimension. The openings 38 will be described in greater detail below. Although FIG. 2A depicts two openings 38 within each slot 36, those of ordinary skill in the art will understand that one or more slots 36 may include one opening 38, no opening 38 at all, or greater than two openings 38.

The docking station 18 may be sized to receive the dispenser 16 within, partially within, or on top of a surface of the docking station 18. The docking station 18 may include conductive elements or contacts, such as conductive pins 40. Though the present disclosure contemplates that conductive pins 40 may extend into one or more slots 36, as described below, those of ordinary skill in the art will recognize that conductive pins 40 may include conductive surfaces positioned on a bottom surface of one or more slots 36.

As detailed in FIG. 2A, for example, the conductive pins 40 may be configured to extend through openings 38 when the dispenser 16 is mounted on the docking station 18. The conductive pins 40 may then be in contact with the blade securing elements 32 or another conductive element of each cartridge 14 when the cartridge 14 is within a slot 36 of the dispenser 16, as will be described below in greater detail. The contact between conductive pins 40 with blade securing elements 32 or another conductive element may complete a circuit, and the removal of the cartridge 14 from the slot 36 may break the contact, and thus open the circuit. According to other aspects, the razor blades 30 may be conductive, such that contact between conductive pins 40 with razor blades 30 may complete a circuit, and the removal of the cartridge 14 from the slot 36 may break the contact, and thus open the circuit. According to further aspects, both the blade securing elements 32 and razor blades 30 may be conductive, and contact between the conductive pins 40 with either the blade securing elements 32 and/or the razor blades 30 may compete a circuit, with current flowing through the blade securing elements 32 and/or the razor blades 30.

Hence, the presence of the cartridge 14 in the slot 36 and contact with the conductive pins 40 simulates an ON-switch operation. Similarly, the removal of the cartridge 14 from the slot 36 and/or when at least one conductive pin 40 is not in contact with a conductive element of cartridge 14 simulates an OFF-switch operation. Even though the cartridge 14 (e.g., the blade securing elements 32, razor blades 30, and/or another conductive element) may not be an ideal conductor (e.g., may have a resistance between approximately 1 ohm and approximately 1000 ohms), the cartridge 14 may still simulate an ON/OFF-switch operation. A certain amount of current may flow between the conductive pins 40 (i.e., the circuit is closed) in the ON-switch operation, and current may not flow between the conductive pins 40 (i.e., the circuit is open) in the OFF-switch operation.

The openings 38 and conductive pins 40 may have an arrangement different than the arrangements as shown in FIGS. 1 and 2A. For example, the openings 38 and conductive pins 40 may have any position that allows contact with the blade securing elements 32 or another conductive element in the cartridge 14 when cartridge 14 is received in the slot 36. According to some aspects, the openings 38 and/or conductive elements or pins 40 may be positioned in only one slot 36 or a subset of slots 36, or each slot 36. For example, each slot 36 may include one or more openings 38. More particularly, the openings 38 and/or conductive pins 40 may be positioned in only the first slot 36A, second slot 36B, third slot 36C, or in only last slot 36D. For example, each of slots 36A-36D may include openings 38, but only one of the slots 36A-36D may include conductive pins 40. According to further aspects, the openings 38 and conductive pins 40 may be positioned in the first slot 36A and last slot 36D, or the openings 38 and conductive pins 40 may be positioned in the third slot 36C and last slot 36D. Hence, the openings 38 and/or conductive pins 40 may be positioned in each slot 36 or any combination of at least one slot 36. According to further aspects, where the dispenser 16 and docking station 18 may be one integral element, the conductive pins 40 may be replaced with flat conductive surfaces operably coupled to electronics and other circuitry within the dispenser 16 and/or the docking station 18.

Figure 2B:
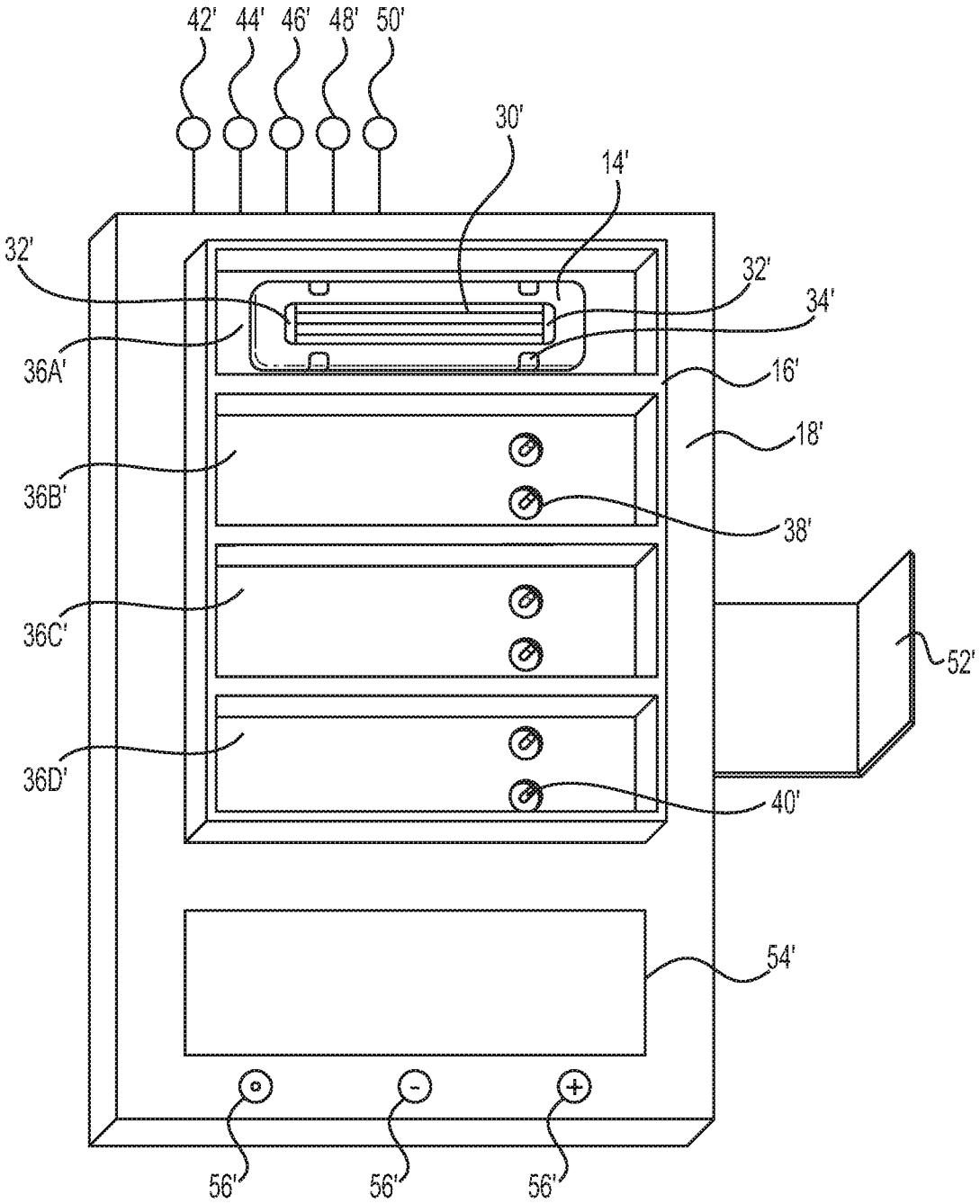

According to further aspects, FIG. 2B illustrates another exemplary aspect of an arrangement of the dispenser 16', openings 38' and conductive pins 40'. The dispenser 16' of FIG. 2B may be substantially similar to the dispenser 16 of FIG. 2A. Specifically, the dispenser 16' may include one or more of the features described above in connection with the dispenser 16 depicted in FIG. 2A.

Figure 3A:
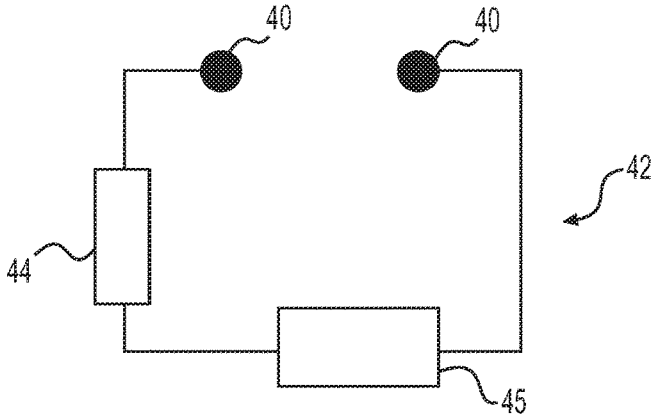
FIGS. 3A-3C illustrate various electrical circuits to sense the presence or absence of a razor cartridge, according to aspects of the present disclosure.
Figure 3B:
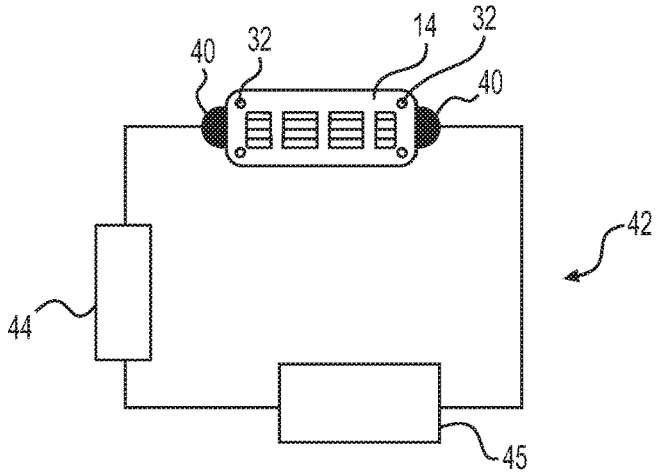
Figure 3C:
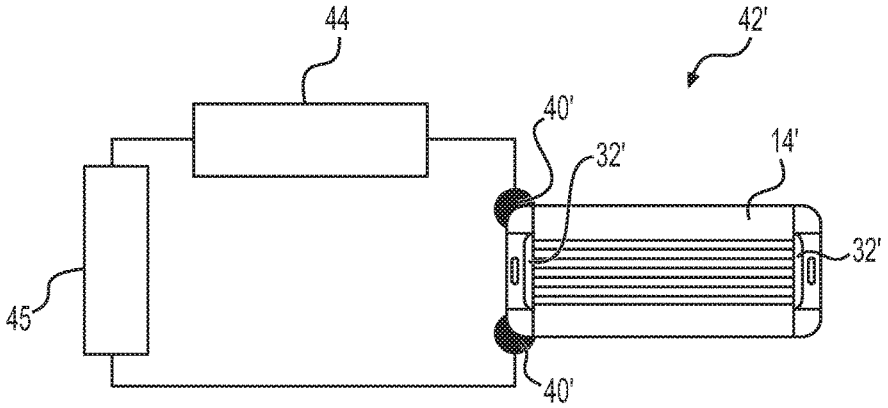

As shown in FIG. 2B, a pair of openings 38' and/or a pair of conductive pins 40' may be positioned in one or more slots 36' on one side of the dispenser 16' and docking station 18', such as, for example, a right side. According to an aspect, the distance between the pair of openings 38' and/or the pair of conductive pins 40' may be less than a length of the conductive blade securing elements 32'. Moreover, the dispenser 16' and docking station 18' may be open on a side opposite to the pairs of openings 38' and/or conductive pins 40', such as, for example, a left side. As such, a user may couple a handle (e.g., handle 12) to a cartridge 14' via a handle coupling portion 34', and may either slide the cartridge 14' out of the open side of the dispenser 16' and docking station 18' or may otherwise remove the cartridge 14' from the dispenser 16'. As shown in FIG. 3C and discussed in greater detail below, when the cartridge 14' is positioned fully within the dispenser 16', the blade securing elements 32' or another suitable conductive element may contact the conductive pins 40' and complete a circuit. The circuit may be complete without current extending across the longitudinal face of the cartridge 14' or through the blades 30'. When a user removes the cartridge 14', the circuit may be opened because the blade securing elements 32' may no longer be in contact with the conductive pins 40'.

With reference to FIGS. 2A, 2B, and 3A-3E, the docking station 18 (or the combination of the dispenser 16 or dispenser 16' and the docking station 18 or docking station 18') may further include one or more of a circuit 42, a battery 44, an electronic circuit 45, a microcontroller 46, a communication unit 48, and a memory 50. As alluded to above, when a cartridge 14 is positioned with a slot 36 so as to be in contact with both conductive pins 40, the circuit 42 (shown in, e.g., FIGS. 3B and 3C) may be completed. The conductive pins 40 may be physically separated to be electrically isolated from each other, so the circuit 42 may only be completed when the blade securing elements 32 (or the other conductive elements) may be in contact with both conductive pins 40. As shown in FIG. 3C, the conductive pins 40' may take an arrangement similar to that shown in FIG. 2B. For example, the conductive pins 40' and corresponding openings 38' (if necessary) may be positioned on one side of the slot 36' such that a blade securing element 32' (or other suitable conductive element) on the respective side of cartridge 14' may contact the conductive pins 40' to complete the circuit 42'.

The circuit 42 may be powered by the battery 44. According to some aspects, however, the circuit 42 may be coupled to a separate power source either within the docking station 18 or separate from the docking station 18. For example, the docking station 18 may be configured to be coupled to a household electrical socket providing electrical energy between 110V-240V. Circuit 42 may also be electrically connected to an electronic circuit 45, which may include a microcontroller or other suitable electronics associated with the docking station 18.

Figure 3D:
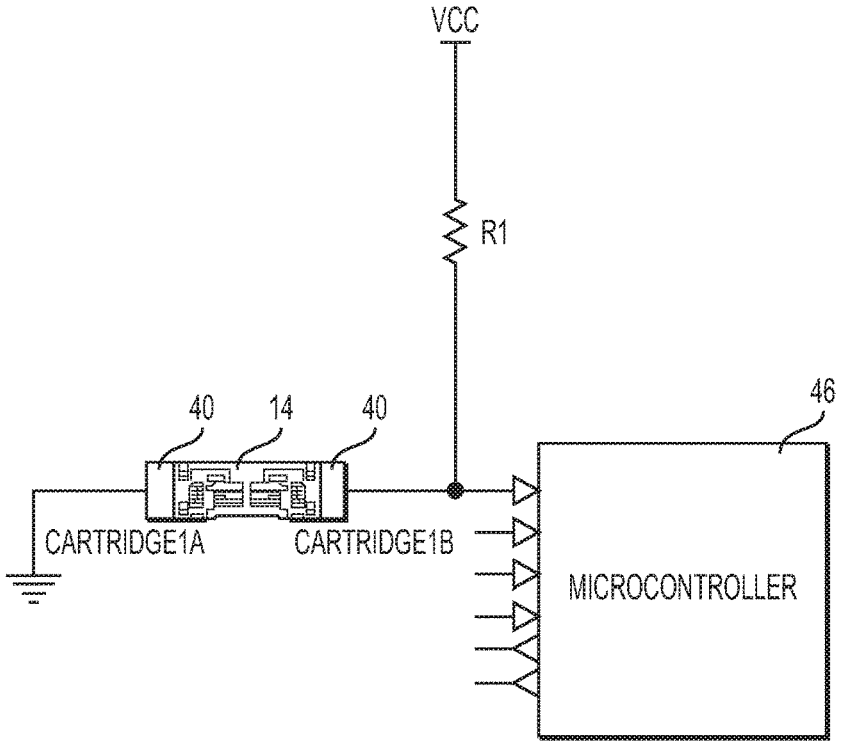
FIGS. 3D and 3E illustrate use of a microprocessor configuration to sense the presence or absence of a razor cartridge, according to aspects of the present disclosure.
Figure 3E:
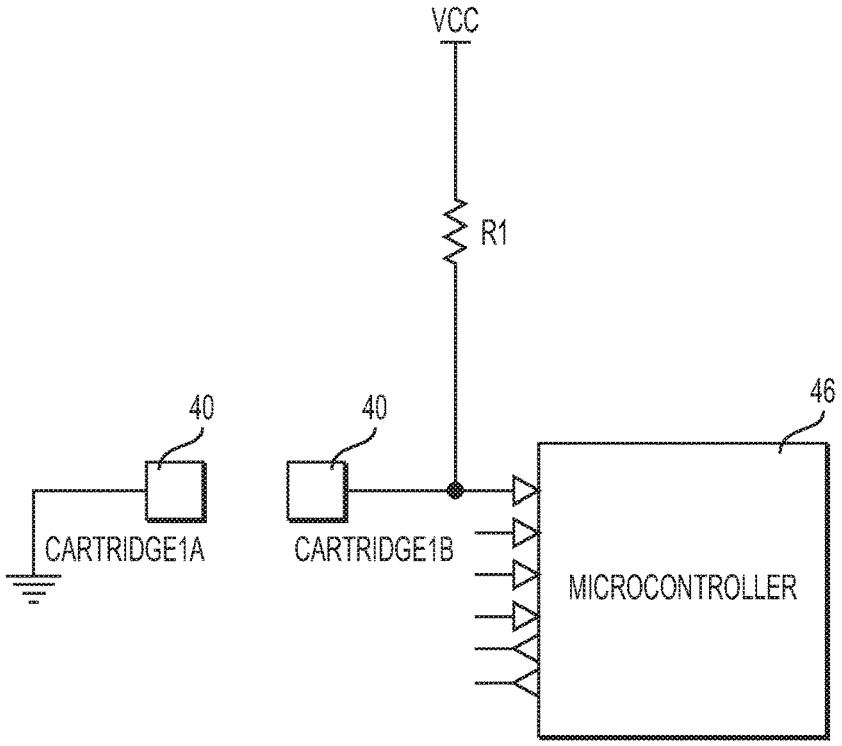
Figure 4A:
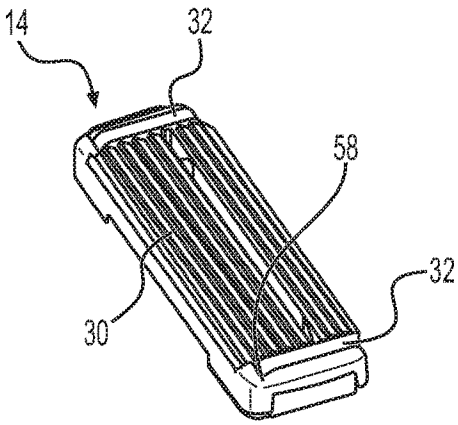
FIGS. 4A-4D illustrate various exemplary razor cartridge assemblies, according to aspects of the present disclosure.
Figure 4B:
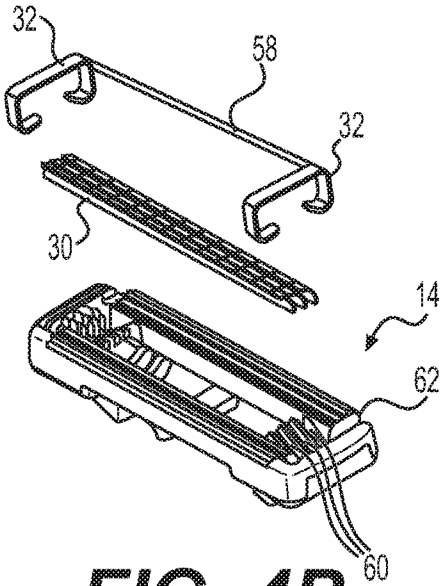
Figure 4C:
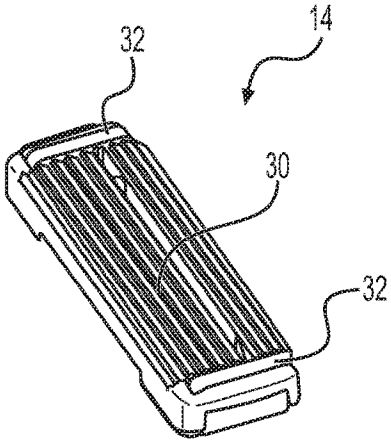
Figure 4D:
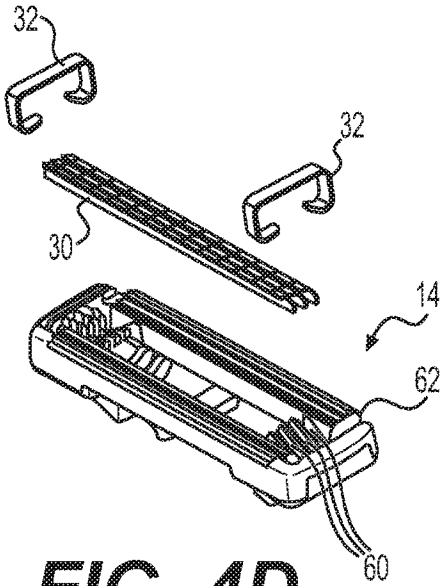

As is shown in FIGS. 3D and 3E, microcontroller 46 may generate a current and/or measure the current when the circuit 42 is completed. The communication unit 48 may include a wireless or wired internet connection to send and/or receive electronic information. The communication unit 48 may also include a transmitter and/or receiver to exchange electronic information with the user device 20, for example, a Bluetooth™, AirDrop™, wireless internet, or any other suitable connection now known or that may be similarly developed in the future. The memory 50 may be coupled to the microcontroller 46 and communication unit 48 to store information such as, for example, the number of times the circuit 42 may be open and/or closed based on the placement and/or removal of the cartridge 14 in/from the dispenser 16. A battery (or any other suitable power source) may power the microcontroller 46, communication unit 48, and/or memory 50. The microcontroller 46, communication unit 48, and/or memory 50 may be electronically connected such that information processed by the microcontroller 46 may be transmitted to and from the user device 20 and/or the merchant unit 22, and also stored or accessed via the memory 50.

According to some aspects, the docking station 18 may also include a handle holder 52 (shown in, e.g., FIG. 2A), a display 54, and an input 56. The handle holder 52 may extend from or be built into the docking station 18 and may be configured to receive the handle body 26 of the handle 12. The handle holder 52 may further include a snap or locking mechanism to removably secure the handle 12 to the docking station 18 between uses or during travel. The display 54 may be any suitable display, including, but not limited to, a liquid crystal display (LCD) unit. The display 54 may visually or graphically display information to a user, for example, usage history and/or indications to replace or reorder the cartridges 14. The display 54 may provide shaving or usage advice or other information to the user. According to further aspects, the docking station 18 may solicit or otherwise request input or feedback from a user via, e.g., the display 54. For example, information may be displayed during, before or after a shave, or in response to a user input. The input 56 may allow a user to respond to prompts displayed on the display 54, such as, for example, to confirm a reorder operation. According to some aspects, the input 56 may be touch sensitive, such as, for example, buttons. According to other aspects, however, the input 56 may be replaced with voice-activation technology so that a user may speak commands to the docking station 18. As such, the docking station 18 may also include a speaker and microphone to provide and receive voice instructions. The input 56 may also allow a user to modify the information displayed on the display 54, such as, for example, to input user information, to toggle information sets, to change settings, to reset a usage indicator, or to adjust reorder preferences. The input 56 may also include a power switch to turn the electronic components of the docking station 18 on and off. According to further aspects, the display 54 may be touch sensitive such that the user may respond to prompts and/or modify the information presented on the display 54 by simply touching the display 54.

The user device 20 may be a smartphone, tablet, smartwatch, computer, or other device. The user device 20 may also include a downloadable mobile application. The mobile application may be a user interface for the system 10, including providing and/or storing information related to the cartridges 14, dispenser 16, and docking station 18, and information related to the user, etc. The mobile application may also be configured to receive information from docking station 18 and/or the merchant unit 22 through the connection between the user device 20 and docking station 18, or through the connection between the user device 20 and the internet 24. The mobile application may also transmit information to the merchant unit 22 in order to provide user data, to place replacement orders, etc. The mobile application may also provide the same information and user interaction as discussed above with respect to the display 54 on the docking station 18.

According to further aspects, the microcontroller 46 may, for example, be a Microchip PIC16F1823 microcontroller working at 2.5V DC with a resistor of approximately 10 Kohms. As is shown in FIGS. 3D and 3E, the microcontroller 46 and a pull-up resistor may be connected to one conductive pin 40, and a ground may be connected to another conductive pin 40. According to other aspects, a general purpose input-output pin ("GPIO pin") of the microcontroller 46 may be pulled up (i.e., high logic level) (FIG. 3E) when connected to the resistor which may be either internal pullup (integrated inside the microcontroller) or external as in the FIGS. 3D-3E. Additionally, the GPIO pin of the microcontroller 46 may be pulled down (i.e., low logic level) when conductive pins 40 may be electrically connected, for example, by a conductive element bridging a multitude of conducting pins 40 (FIG. 3D). When the cartridge 14 connects with the conductive pins 40, as in FIG. 3D, current may flow to the ground, eliminating the current flowing to the high logic level through the pull-up resistor and thus pulling down the microcontroller input from high to low logic level. If the cartridge 14 may be removed, however, as shown in FIG. 3E, no current may flow to the ground because the conductive pins 40 may not be electrically connected, resulting in a higher voltage at the microcontroller input (e.g., pulls up the microcontroller input from low to high logic level). This voltage difference may be used to detect the presence and absence of a cartridge 14 in a slot 36.

The microcontroller 46 may be connected to, and thus monitor, a plurality of conductive pins 40, for instance, pairs of conductive pins 40 for each slot 36 of the dispenser 16 coupled to docking station 18. Each cartridge 14 may act as an electrical conductor having a resistance, so each cartridge 14 may operate as a switch which increases the current to the ground and reduces the input of the microcontroller 46, reducing the voltage delivered to the microcontroller 46. If a plurality of cartridges 14 are positioned within dispenser 16, connecting each pair of conductive pins 40, then the voltage at microcontroller 46 may be relatively low. However, as cartridges 14 are removed, the voltage at microcontroller 46 may increase, and the voltage at microcontroller 46 will be at the maximum when all of cartridges 14 have been removed. The increases may be incremental and correspond to the number of cartridges 14 in dispenser 16, providing information that the microcontroller 46 may provide to the memory 50 and transmit to the other devices of the system 10 to track the usage of cartridges 14.

According to aspects as shown in FIGS. 4A-4D, the blade securing elements 32 may extend generally perpendicularly to a longitudinal axis of the blades 30. As further shown in FIGS. 4A and 4B, a connection portion 58 may extend generally parallel to the blades 30 and may connect two blade securing elements 32. The blade securing elements 32 and connection portion 58 may be electrically conductive. For example, the blade securing elements 32 with a connection portion 58 (FIGS. 4A and 4B) may electrically couple conductive pins 40, shown in FIGS. 2A, 3A, and 3B. As discussed above, the blades 30 themselves may also be conductive and may electrically couple the conductive pins 40, with or without the blade securing elements 32. The blade securing elements 32 without a connection portion 58 (FIGS. 4C and 4D) may electrically couple the conductive pins 40, as shown in FIGS. 2B and 3C, for example. The blade securing elements 32 and connection portion 58 may be separate elements or may be integrally formed of the same conductive material.

The blades 30 may be assembled within the cartridge 14 via any suitable mechanism. For example, the blades 30 may be received and secured within grooves or recesses disposed within a body of cartridge 14. The blade securing elements 32 may then be positioned on or over the blades 30 and either within an additional recess 62 in the cartridge 14 or around the body of the cartridge 14. The blade securing elements 32 may be electronically isolated from the remaining portions of the cartridge 14. For use with conductive pins 40 positioned on opposing sides of a slot 36, for example as shown in FIGS. 1, 2A, 3A, and 3B, the blade securing elements 32 may be electrically coupled together via connection portion 58, or one or more other conductive elements (not shown) configured to electrically couple together the blade securing elements 32, such that the conductive pins 40 may be electrically connected when the cartridge 14 is positioned within the slot 36. For use with conductive pins 40 positioned on the same side of a slot, for example, as shown in FIGS. 2B and 3C, the blade securing elements 32, or any other suitable conductive elements, without the connection portion 58, may extend perpendicularly to the blades 30 such that the conductive pins 40 may be electrically connected when the cartridge 14 is positioned within a slot 36.

Figure 5B:
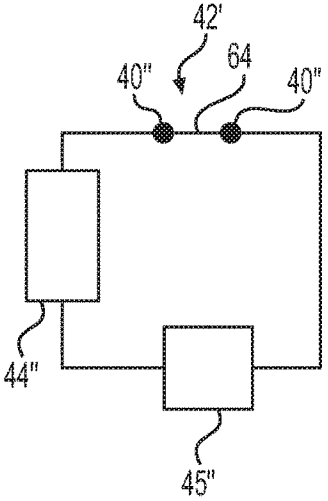
FIGS. 5B and 5D illustrate additional aspects of various electrical circuits to sense or detect the presence or absence of a razor cartridge, according to the present disclosure.
Figure 5D:
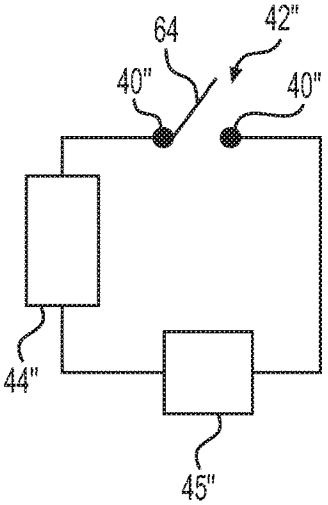
Figure 5A:
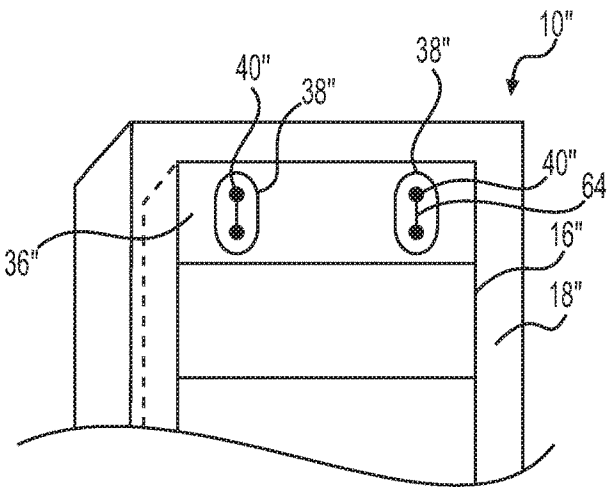
FIGS. 5A and 5C illustrate perspective views of a docking station, a dispenser, and a razor cartridge.
Figure 5C:
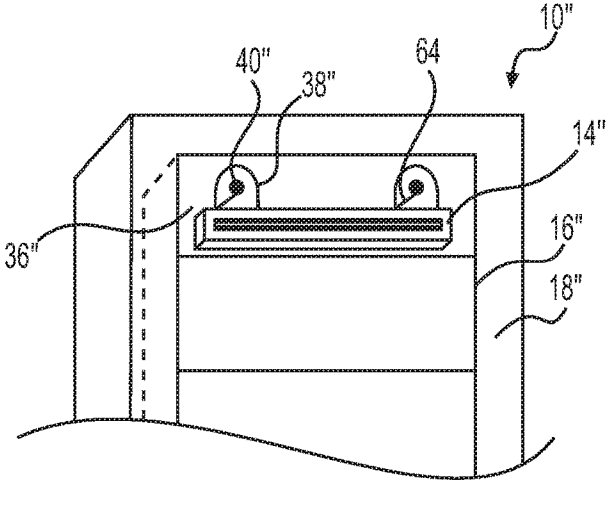

According to further aspects, as shown in FIGS. 5A-5D, a system 10" may include elements similar to a portion of the system 10 discussed above, but where the presence of a cartridge 14" in a slot 36" of the dispenser 16" opens a circuit 42", and the absence of a cartridge 14" in the slot 36" completes the circuit 42". With specific reference to FIG. 5A, the conductive pins 40" may be electrically connected by a biased spring switch 64 when slot 36" is empty, so circuit 42" may be complete (FIG. 5C). The conductive pins 40" and spring switch 64 may extend from the docking station 18" and may be configured to be positioned within one or more slots 36" of the dispenser 16" through the openings 38". The spring switch 64 may be fixedly coupled to one conductive pin 40" and releasably coupled to another conductive pin 40", completing the circuit 42" with the battery 44" and microcontroller 46", as shown in FIG. 5B. However, insertion of a cartridge 14" into the slot 36" may disconnect the spring switch 64 from one conductive pin 40" and open the circuit 42", as shown in FIGS. 5C and 5D. For example, the cartridge 14" may be configured to physically move the spring switch 64 away from and out of contact with at least one conductive pin 40". Hence, the insertion of a cartridge 14" into a slot 36" may be configured to break the circuit 42" by disconnecting the spring switch 64 from at least one conductive pin 40". Accordingly, the cartridges 14", including the blade securing elements (not shown in FIGS. 5A-5D, but similar to the blade securing elements 32), may be configured to prevent or restrict the flow of electrical energy, for example, the blade securing elements may be insulated. The spring switch 64 may be biased to return to connect a pair of conductive pins 40" upon removal of the cartridge 14" from the slot 36", again completing the circuit 42".

According to some aspects and similar to FIG. 2B discussed above, there may only be one pair of conductive pins 40" to form the circuit 42" and detect the absence or presence of a cartridge 14" in the slot 36". According to further aspects, there may be two pairs of conductive pins 40" forming a circuit for the slot 36", or each pair of conductive pins 40" may form a separate circuit 42", such that each pair of conductive pins 40" may detect the absence or presence of a cartridge 14" in the slot 36". Moreover, the conductive pins 40" may be positioned in any of the arrangements discussed above and in any number of the slots 36", and may include a bias connection by spring switch 64. Each slot 36" containing conductive pins 40" and a spring switch 64 that may be coupled to the microcontroller 46" with a voltage source and a ground such that when the spring switch 64 is closed, the voltage at the microcontroller 46" is reduced; and when the spring switch 64 is opened, the voltage at the microcontroller is increased.

Figure 8A:
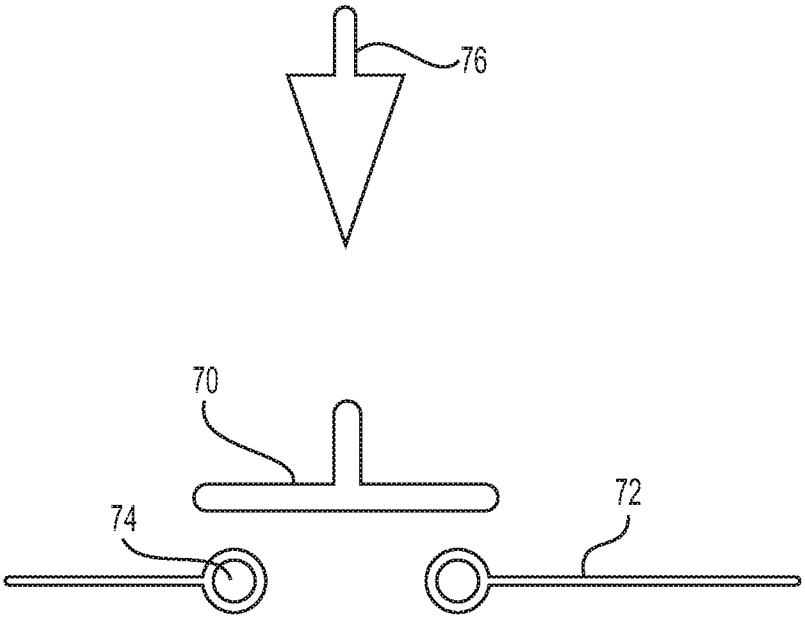
FIGS. 8A and 8B illustrate additional aspects of various electrical circuits to sense or detect the presence, absence, or misalignment of a razor cartridge, according to the present disclosure.
Figure 8B:
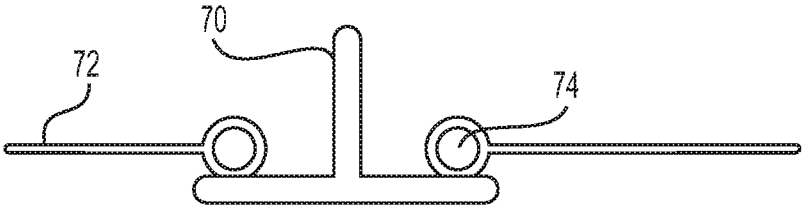

In another aspect of the disclosure, a push button may be used instead of, or in addition to, conductive pins. For example, as is shown in FIGS. 8A and 8B, a push button 70 may be used to open or close a gap in circuit 72 (a portion of which is depicted in FIGS. 8A and 8B). FIG. 8A depicts a push button 72 biased to maintain circuit 72 in an open configuration, and FIG. 8B depicts a push button 72 biased to maintain circuit 72 in a closed configuration. Circuits 72 depicted in FIGS. 8A and 8B may be part of a larger system, like system 10 or system 10", described above. As such, circuits 72 may be associated with a slot into which a cartridge may be received, a dispenser, a docking station, or a combination thereof.

In one embodiment, push button 70 may be biased (via, e.g., a spring element) into an open configuration (i.e., normally open, as shown in FIG. 8A). The presence of a cartridge in the slot associated with circuit 72 of FIG. 8A may cause force to be applied by the cartridge in the direction of arrow 76 to depress push button 70 into a closed configuration. In the closed configuration, push button 70 may span the gap between two circuit end points 74. Push button 70 may include conductive material to electrically connect end points 74 when depressed, allowing current to flow. When the cartridge is removed from the slot, push button 70 may be released, and circuit 72 may open, disrupting the flow of current. Thus, if no cartridge is located in the slot associated with circuit 72, circuit 72 may be open, and if a cartridge is located in the slot associated with circuit 72, circuit 72 may be closed. In some aspects, end points 74 may each include a conductive pin.

In another embodiment, push button 70 may be biased (via, e.g., a spring element) into a closed configuration (i.e., normally closed, as shown in FIG. 8B). The presence of a cartridge in the slot associated with circuit 72 of FIG. 8B may cause force to be applied by the cartridge in the direction of arrow 76 (FIG. 8A) to depress push button 70 into an open configuration. In the closed configuration, push button 70 may span the gap between two circuit end points 74. Push button 70 may include conductive material to electrically connect end points 74 when no cartridge is present, allowing current to flow. When the cartridge is present within the slot, button 70 may be depressed, and circuit 72 may open, disrupting the flow of current. Thus, if no cartridge is located in the slot associated with circuit 72, circuit 72 may be closed, and if a cartridge is located in the slot associated with circuit 72, circuit 72 may be open. In some aspects, end points 74 may each include a conductive pin. Some push-button embodiments may act as a stand-alone detection system, and apart from the terminals (e.g., circuit end points 74) of a push-button switch associated with an electronic circuit board, no additional conductive elements may be required.

Figure 9A:
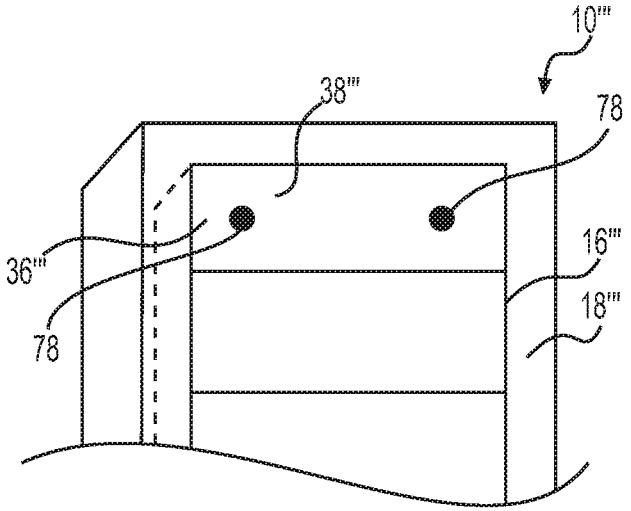
FIGS. 9A and 9B illustrate additional aspects of various sensors to detect the presence, absence, or misalignment of a razor cartridge, according to the present disclosure.
Figure 9B:
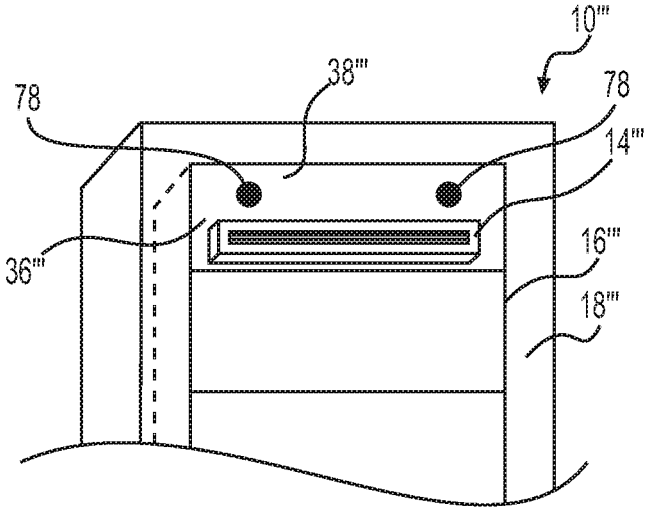

In some embodiments, one or more proximity sensors may be incorporated into systems of the disclosure in addition to, or instead of, the circuits described above. One or more proximity sensors may be configured to detect whether a cartridge is present in a slot of the present disclosure. FIGS. 9A and 9B depict exemplary embodiments of a system 10''' including one or more proximity sensors 78. As is shown in FIG. 9A, proximity sensors 78 may be included in a portion of a slot 36''' of dispenser 16''' and/or on a portion of docking station 18'''. Although two proximity sensors 78 are shown in slot 36''' of FIG. 9A, one proximity sensor or more than two proximity sensors may be included. Additionally, proximity sensors may be incorporated in one slot 36''' or more than one slot 36''' or may be located in any suitable position relative to slot 36''' or opening 38''' of slot 36'''.

As shown in FIG. 9B, a cartridge 14''' may be contained within slot 36'''. When cartridge 14''' is located within slot 36''', it may be within the nominal range of proximity sensors 78, which may detect the presence of cartridge 14'''. Proximity sensors 78 may not need to physically contact cartridge 14''' in order to detect the presence of cartridge 14'''. In this way, system 10''' may be configured to monitor whether or not cartridge 14''' is within slot 36''' via use of proximity sensors 78. In some aspects, system 10''' may be configured to generate a signal when removal of cartridge 14''' is detected.

One or more proximity sensors 78 may include a capacitive, radio frequency (RF), photoelectric, optical, electromagnetic, a suitable inductive proximity sensor, and/or any other proximity sensor or sensing technology. In some aspects, a capacitive or photoelectric proximity sensor may detect the presence of a plastic portion of a cartridge within a slot in which the one or more sensors are associated. In some embodiments, an inductive proximity sensor may detect a metal portion (e.g., a blade or screw) on a cartridge within a slot in which the one or more proximity sensors are associated with. In other embodiments, an RF sensor may detect the presence of an RF signal emitted from an RF chip in the blade. Moreover, the proximity sensor may include a magnetoresistive sensor configured to detect the presence (or absence) of a magnetic field.

Figure 6:
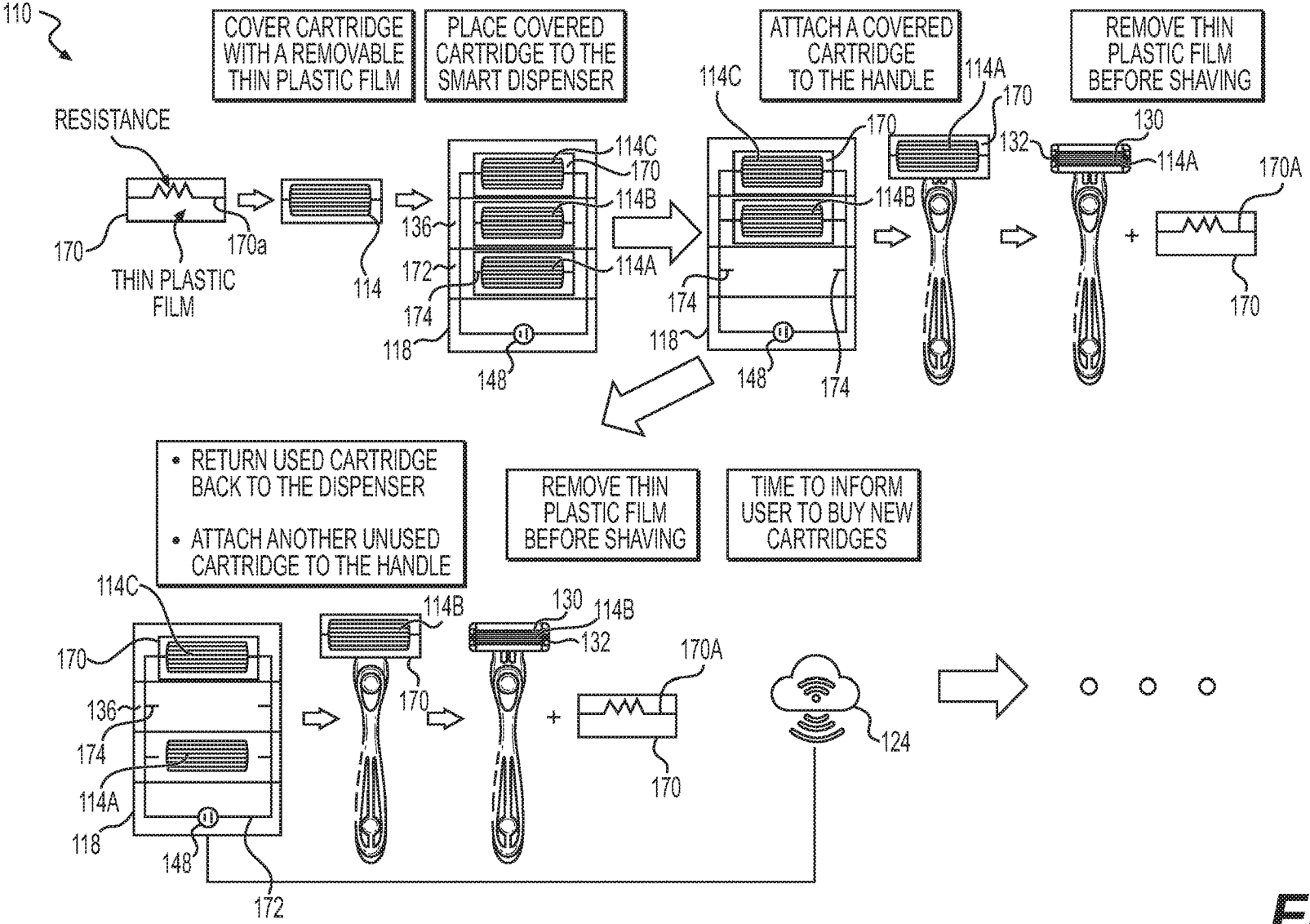
FIG. 6 illustrates an exemplary docking station, a dispenser, a handle, razor cartridges, and a protective film, according to further aspects of the present disclosure.

According to other aspects, as shown in FIG. 6, a portion of a system 110, similar to system 10, may include a protective film 170. The protective film 170 may be positioned over an unused cartridge 114, and may extend beyond the cartridge 114 in at least one direction. A user may remove the protective film 170 from the cartridge 114 before shaving. Although only three cartridges 114 are shown in the dispenser 116 of FIG. 6, it may be contemplated that the dispenser 116 may include any number of slots 136, and any number of cartridges 114 may be positioned in the slots 136. The protective film 170 may be positioned over each cartridge 114 in the dispenser 116, or may be positioned over any one or a subset of cartridges 114. For example, the protective film 170 may be positioned on the first cartridge 114A and the last cartridge 114C, or may be positioned on the second cartridge 114B and the last cartridge 114C.

Alternatively, the protective film 170 may be positioned on only the first cartridge 114A, or may be positioned on only the last cartridge 114C.

As discussed above, the dispenser 116 and the docking station 118 may be separate elements, or may be integrated together as a single component shown collectively as the docking station 118. The docking station 118 may include a circuit 172 with conductive pins 140 (not shown) or electrical connections 174 positioned in each slot 136 where a cartridge 114 with a protective film 170 may be positioned. The slots 136 may vary, for example, there may be one slot 136, more than one slot 136, or there may be any subset of slots 136. The electrical connections 174 may partially extend into the slot 136 (e.g., towards a center of slot 136) from the sides of slots 136, such that the electrical connections 174 may make contact with the protective film 170.

According to some aspects, the protective film 170 may be conductive with a resistance. For example, the protective film 170 may include a conductive element or embedded electrical trace, such as, for example, a thin wire 170*a*, extending across a length or width of the protective film 170. According to other aspects, an entirety or at least a substantial portion of an entirety of the protective film 170 may be conductive itself. The thin wire 170*a* may be disposed on or embedded with the protective film 170*a*. Though only one wire 170*a* is depicted in FIG. 6, more than one wire 170*a* may be embedded and may traverse the protective film 170*a*. When one or more thin wires 170*a* is provided, a remainder of the protective film 170 may be made of an insulating material, such as, e.g., a polymer. When the protective film 170 is positioned in a slot 136 on a cartridge 114, the protective film 170 may contact the electrical connections 174. The protective film 170 may conduct current and have a measurable resistance R. The cartridge 114, including the blades 130 and the blade securing elements 132, may be configured to avoid contact with the electrical connections 174 when positioned in the slot 136 without the protective film 170.

For instance, when three cartridges 114A, 114B, and 114C, each with a protective film 170, are positioned in the slots 136 of the docking station 118, the docking station 118 may transmit a current through the circuit 172 connected to each electrical connection 174. The resulting voltage drop may be indicative of a resistance of 3 R because there are three protective films 170, each having a resistance R, that may be transmitting current. If a user removes a cartridge 114 for use, the user would then remove the protective film 170 from the cartridge 114. As such, if cartridge 114 is placed back into the same slot 136, the resulting voltage drop in the circuit 172 of the docking station 118 would indicate a resistance of 2 R. According to further aspects, to prevent the user from reapplying the protective film 170 to the used cartridge 114, the protective film 170 may be provided with a single-use adhesive. However, according other aspects, the protective film 170 may be fabricated from a material that loses its applied configuration once removed from the cartridge 114, thereby making it difficult to re-apply the protective film 170. As a result, the docking station 118 may be configured to determine when a new cartridge 114 may be first used, and determine how many unused cartridges 114 that may remain in the dispenser 116.

Based on user data or a programmed algorithm, the docking station 118 may store usage information, provide the same information to a user via a display 54 on the docking station 118 (as in FIGS. 1 and 2), or may transmit the information via a communication unit 148 to a user device to be displayed to the user or stored in a mobile application. The docking station 118 may automate replacement ordering by contacting a merchant via the communication unit 148, or may provide a prompt to the user via the display 54 on the docking station 118 or via the user device to confirm a replacement order within a certain period of time. For example, if the second to last cartridge is used, the docking station 118 may place or prompt an order using regular shipping. If the last cartridge is used without a previous replacement order being placed, the docking station 118 may place or prompt an order using expedited shipping. The placement or prompting of an expedited ship order may be based on the accumulated user information, such as, for example, average time between new cartridges, and/or based on input user information, such as, for example, gender, age, preferred trimming or shaving style, etc. The docking station 118 may display or otherwise convey the accumulated user information via the display 54 or user device 20. For example, the docking station 118 may display the number of shaves each cartridge 114 may perform (which may be automatically detected or may be based on user input), how many shaves a cartridge 114 may be designed to perform, how long the user may have used each cartridge 114, the cost per shave based on the cost of the cartridges 114 and the number of times each cartridge 114 may be used, and/or length of time each dispenser 116 containing a certain amount of cartridges 114 may last.

Furthermore, the docking station 118 may receive information from the merchant. For example, the merchant may transmit information to the docking station 118 to be displayed or otherwise conveyed to the user such as, for example, sales, coupons, proximity based information, merchant inventory (both understocked or overstocked), different types of cartridges, shaving accessories and/or products, a loyalty point system (for example, every fifth dispenser may be free), referral bonuses, and other promotions.

According to further aspects, the protective film 170 may be insulating, and the cartridge 114, including the blades 130 and the blade securing elements 132, may be conductive and include a resistance. The cartridges 114 may be distributed in the docking station 118 with the protective film 170 on the cartridges 114, and the circuit 172 and the electrical connections 174 may not conduct current, which may be measured by any method as discussed above. If a user removes a cartridge 114 for use and removes the protective film 170 from the cartridge 114, and then places the cartridge 114 (together or separate from a handle) into the slot 136, the electrical connections 174 may be electrically connected through the blades 130, or the blade securing elements 132, and may conduct a current. The blades 130 and/or blade securing elements 132 may have a resistance, and the docking station 118 may be capable of measuring the resistance. The docking station 118 may also detect when a user removes the cartridge 114 from the slot 136 for the next usage. As such, the docking station 118 may collect information on how frequently a user may shave, the number of shaves for which the user may use a particular cartridge 114, and/or duration of each shave, etc. The docking station 118 may be connected to a user device and/or to the internet 124 or other connection through the communication unit 148, and may initiate or offer an option to order additional cartridges 114 and/or dispensers 116 of the cartridges 114 based on the number of new or otherwise unused cartridges 114 in the dispenser 116. For example, as illustrated in FIG. 6, the system 110 may transmit a signal from the communication unit 148 to a user device 20 (shown in FIG. 1) or to a merchant unit 22 (shown in FIG. 1) that it may be time to buy new cartridges 114 when the user first removes the second to last cartridge 114B from docking station 118.

According to other aspects, system 110 may include both conductive pins 40 extending from the docking station 118 through an appropriate number of openings in a dispenser 116 (if separate from the docking station 118) as discussed above in regard to FIGS. 1-6 and the electrical connections 174. As such, the system 110 may determine the presence and absence of both unused cartridges 114 (covered by a protective film 170) and the presence and absence of used cartridges 114 (uncovered by a protective film 170). Based on the information received, the system 110 may determine the remaining supply of cartridges 114, as well as obtain usage data for the shaving habits of the user and the cartridge 114 usage.

Figure 7A:
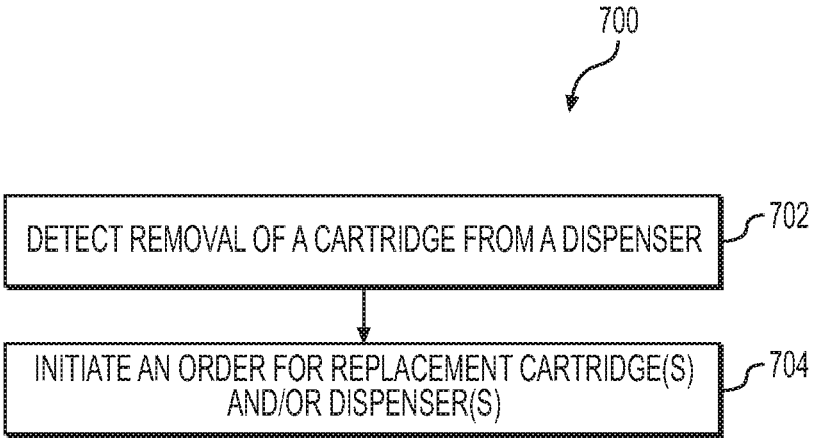
FIGS. 7A-7C are flow diagrams of exemplary methods for receiving information related to usage and order placement of razor cartridges, according to aspects of the present disclosure.
Figure 7B:
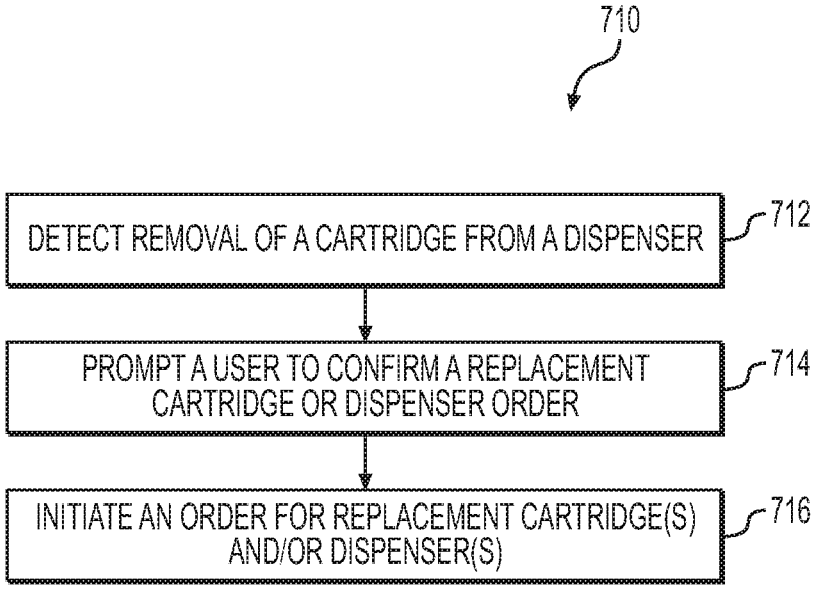
Figure 7C:
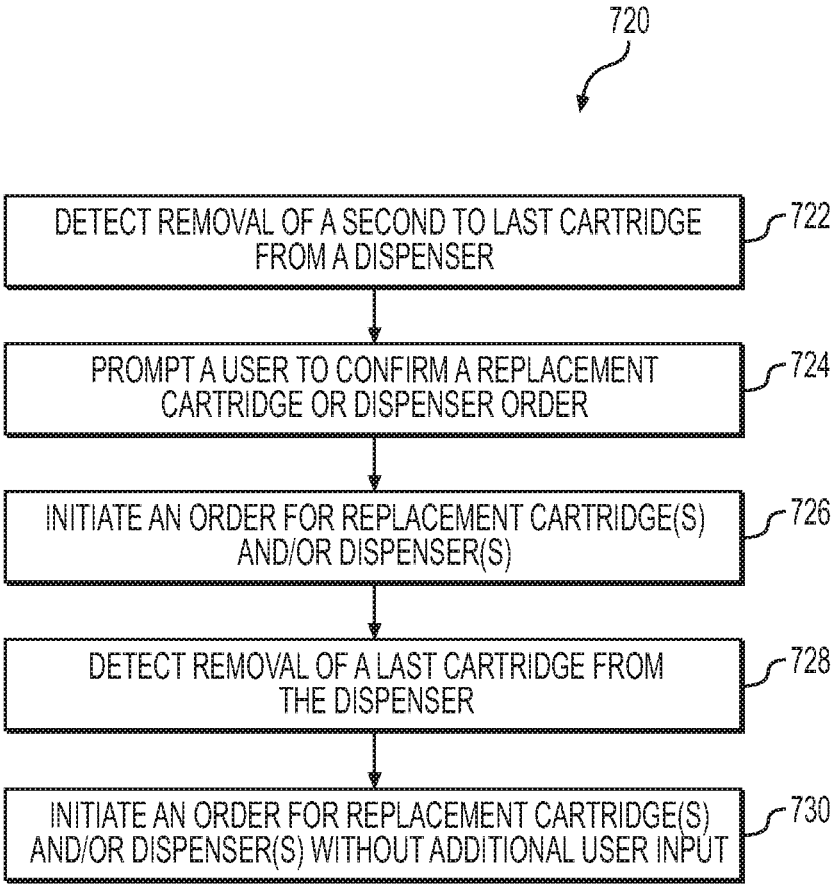

According to some aspects, FIGS. 7A-7C depict flow diagrams of exemplary methods for receiving information related to usage of razor cartridges and order placement. For example, as detailed in FIG. 7A, a method 700 may include a step 702, in which the removal of a cartridge 14 from a slot 36 may be detected by system 10. The removal of the cartridge 14 from the slot 36 in the dispenser 16 may open or complete a circuit 42. A microcontroller 46 may sense a change in the circuit 42. In step 704, an order for replacement cartridge(s) 14 and/or dispenser(s) 16 of the cartridges 14 may be initiated. The microcontroller 46 may transmit a command to initiate an order for replacement cartridge(s) 14 and/or dispenser(s) 16. The command may be transmitted from the docking station 18 to the merchant unit 22 via the internet 24, as shown in FIG. 1.

According to further aspects, FIG. 7B shows another exemplary method 710. For example, step 712 may include detecting the removal of a cartridge 14 from a slot 36 in a dispenser 16, which may open or complete a circuit 42. A microcontroller 46 may sense the change in the circuit 42. In step 714, a user may be prompted to confirm that a replacement cartridge 14 and/or dispenser 16 order may be initiated. The microcontroller 46 may transmit a prompt to a user to confirm the replacement cartridge 14 and/or dispenser 16 order. This may include a prompt provided on the display 54 of the docking station 18 or on the user device 20 for a user to selectively confirm the replacement order. The prompt may be in the form of a push notification, a text message, an email, an automated telephone call, or any other similar type of prompt. The user may then confirm or decline the replacement order by touching a button on the docking station 18 or on the user device 20, responding to the text message, pressing a specific number or number combination on a telephone, or any other similar type of response to a prompt. The prompt may be displayed on and responded to via a mobile application on the user device 20. In step 716, an order for replacement cartridge(s) 14 and/or dispenser(s) 16 may be initiated once system 10 receives the confirmation from the user. The microcontroller 46 may transmit a command to initiate the order for replacement cartridge(s) 14 and/or dispenser(s) 16, and the transmission may be from the docking station 18 to the merchant unit 22 through a connection to the internet 24. According to some aspects, the user may have a certain time period, for example two days, to confirm or decline the replacement order. According to further aspects, if the user does not decline the replacement order in the certain time period, the replacement order may be automatically initiated without further user intervention or input.

According to further aspects, as shown in FIG. 7C, another exemplary method 720 is detailed wherein, a step 722 may include detecting the removal of a second to last cartridge 14 from a slot 36 in a dispenser 16. This removal may be detected by a microcontroller 46 in a docking station 18. Step 724 may include prompting a user to confirm a replacement cartridge 14 and/or dispenser 16 order, as discussed above regarding FIG. 7B. This prompt to the user may also include an option to have the replacement cartridge (s) 14 and/or dispenser(s) 16 delivered to the user via standard shipping. The standard shipping prompt to the user also may be an option to place the replacement cartridge 14 and/or dispenser 16 order, but without an automated purchase if the user does not intervene. Step 726 may include initiating an order for replacement cartridge(s) 14 and/or dispenser(s) 16 based on the prompt and a response from the user in Step 724. Step 728 may include detecting the removal of the last cartridge 14 from dispenser 16. The microcontroller 46 may detect the opening or closing of the circuit 42, and may send a signal to the user via any of the transmission techniques previously mentioned. In step 730, an order for replacement cartridge(s) 14 and/or dispenser(s) 16 of cartridges 14 may be initiated without additional user input. The microcontroller 46 may automatically transmit a command to initiate an order for replacement cartridge(s) 14 and/or dispenser(s) 16. The command may be transmitted from the docking station 18 to merchant unit 22 via the internet 24, as shown in FIG. 1. The command may include an order via expedited delivery, or the delivery method may be automatically selected based on the stored user data and/or preferences.

Any of the foregoing methods 700, 710, and 720 may be performed for a dispenser 16 including conductive pins 40 in one, two, or each slot 36. Similarly, the methods 700, 710, and 720 may be selectively performed based on when reordering may be desired to occur. For example, the methods 700, 710, and 720 may be performed for the first cartridge 14 if reordering is desired to occur while the user has a plurality of cartridges 14 remaining. Alternatively, the methods 700, 710, and 720 may be performed when the last or second to last cartridge 14 is removed from the corresponding slot 36. Moreover, as discussed above, conductive pins 40 and/or electrical connections 174 may be positioned in each slot 36 such that the docking station 18, microcontroller 46, and memory 50 may collect user usage data. Likewise, a user may return a cartridge 14 to a slot 36 between uses, electrically connecting the conductive pins 40 again, such that information on the time between uses, duration of use, uses per cartridge, etc. may be collected. This user data may be stored in memory 50, and the microcontroller 46 may factor in the user data in the user prompting and ordering steps as detailed above.

Furthermore, in any of the aforementioned methods, the user may have the option to order multiple dispensers 16 of cartridges 14, additional handles 12, or other products from the merchant unit 22. The microprocessor 46 and/or the merchant unit 22 may track these optional purchases and incorporate the selections in future prompts and orders. For example, if the user orders two replacement dispensers 16 full of cartridges 14, the microcontroller 46 may not initiate an order or prompt the user to place an order for replacement cartridges until the user has depleted one replacement dispenser 16 and is using the cartridges 14 of the second replacement dispenser 16. The microcontroller 46 may track the first replacement dispenser 16 being inserted into and later removed from docking station 18 where, for example, docking station 18 may be configured to removably receive the dispenser 16. According to some aspects, the dispenser 16 or cartridges 14 may include radio-frequency identification tags or other identifying markers that may allow the microcontroller 46 of docking station 18 to recognize each dispenser 16. The identifying markers may also be transmitted from the merchant unit 22 to the docking station 18 via the internet 24 so the docking station 18 may recognize the receipt and placement of particular dispensers 16 or cartridges 14 into the docking station 18.

Additional aspects may be incorporated in any of the elements and systems discussed above. For example, the dispenser 16 and docking station 18 may monitor and store how many times a cartridge 14 has been used. Such information may be user input information or may be automatically collected by sensing the presence or absence of the cartridge 14 in a slot 36 as discussed, or by sensing the presence or absence of the handle 12 on the handle holder 52. The docking station 18 may store a recommended number of usages for each cartridge 14. The recommended number of usages may be a standard number, or the recommended number of usages may vary depending on the type of cartridge 14, user shaving habits, user hair and body type, etc. The user hair and body type may be monitored by elements coupled to the cartridge 14 and/or the razor handle 12, such as, for example, a camera or other sensing element. If a cartridge 14 has been used more than the recommended number of usages, the docking station 18 may produce an audible or a visible notification to indicate to the user that he or she should replace the cartridge 14. This notification may also be sent to the user device 20. This notification may appear on the display 54 of the docking station 18, may be a flashing light, or any other indication. The docking station 18 may include a manual reset to override the cartridge usage notification. The notification may also be based on the number of user strokes detected by a stroke sensing element coupled to or a part of the cartridge 14 or handle 12, in addition to number of usages. For example, if a user is only trimming the edges of a beard, the user may use fewer strokes, and thus the cartridge 14 may have a higher recommended number of usages than if the user was shaving a face or legs and using a greater number of strokes.

The docking station 18 also may serve as a charging station for an electric razor. For example, the docking station 18 may include a razor connection. The razor connection may be wired or wireless, to allow for wired or wireless charging of the electric razor. The docking station 18 may also include a razor mount, and the razor connection may be a wireless antenna charging connection such that the docking station 18 may charge the razor when the razor is placed on the razor mount. If the razor connection is wired, docking station 18 may include a cable output of a specific voltage level appropriate for recharging the battery of the electric razor. Alternatively, the docking station 18 may include a cavity (not shown) and/or extension element (not shown) that includes charging pins (not shown) on which the electric razor may be mounted in order to recharge the battery of the electric razor. The cartridge sensing capabilities discussed above may also be used for electric razor blades.

The systems 10, 100, and methods 700, 712, and 720 may allow a user to more efficiently and effectively track razor cartridge usage and place replacement razor cartridge orders. In particular, a user may more easily order cartridges 14 and other products when the user may be in need of replacements. Moreover, a user may more easily track the lifetime of a particular cartridge 14. The system may assist in ensuring that the user does not use a cartridge 14 beyond the recommended usage, and may also assist in ensuring that the user does not discard a cartridge 14 before the recommended cartridge lifetime. The disclosed systems and methods also may provide a merchant the ability to track cartridge usage and purchasing patterns of a user. As such, the merchant may provide targeted advertisements or offers to the user, or to other potential consumers in locations close to the user. Additionally, it is understood that the systems and methods disclosed herein may be applied to various other applications as well, including replacement heads for an electronic toothbrush and any other replaceable element.

While principles of the present disclosure are described herein with reference to illustrative examples for particular applications, it should be understood that the disclosure is not limited thereto. Those having ordinary skill in the art and access to the teachings provided herein will recognize additional modifications, applications, embodiments, and substitution of equivalents all fall within the scope of the features described herein. Accordingly, the claimed features are not to be considered as limited by the foregoing description.

What is claimed is:

1. A shaving system, comprising:

a dispenser including a plurality of slots, a first slot of the plurality of slots is configured to releasably receive a cartridge having at least one razor blade and a blade securing element; and an electrical circuit associated with the first slot and including a first electrically conductive element and a second electrically conductive element, the first electrically conductive element and the second electrically conductive element are spaced apart from one another to form a gap therebetween;

wherein:

the electrical circuit is configured to switch between an open configuration in which the gap is unbridged between the first electrically conductive element and the second electrically conductive element and a closed configuration in which at least one of the blade securing element or the at least one razor blade spans the gap, electrically connecting the first electrically conductive element and the second electrically conductive element;

the system is configured to detect removal of a first cartridge from the first slot based on whether the electrical circuit is in the open configuration or the closed configuration; and the system is configured to generate a signal when removal of the first cartridge is detected.

2. The system of claim 1, wherein the signal is configured for transmission to a third party.

3. The system of claim 1, wherein the first slot contains the first cartridge positioned therein, and the first cartridge positioned within the first slot switches the electrical circuit into the closed configuration.

4. The system of claim 1, further including a docking station configured to receive the dispenser, wherein at least a portion of the electrical circuit is included as part of the docking station, and wherein the system is configured to detect placement of the cartridge back into the dispenser, and the docking station is configured to collect information on shaving frequency or shaving duration.

5. The system of claim 1, wherein at least a portion of the electrical circuit is included as part of the dispenser.

6. The system of claim 1, further comprising at least one proximity sensor, wherein the system is configured to detect the removal of the cartridge from the slot using the at least one proximity sensor.

7. The system of claim 1, further comprising a push button, wherein the system is configured to detect the removal of the cartridge based on whether or not the push button is depressed.

8. The system of claim 1, wherein the signal is a request for delivery of at least one new cartridge.

9. The system of claim 1, wherein the system includes the cartridge having the at least one razor blade, and the at least one razor blade is configured to span the gap to electrically connect the first electrically conductive element and the second electrically conductive element.

10. The system of claim 1, further comprising at least one controller, a communication unit, a memory, and a display, wherein:

the system includes the cartridge, and the cartridge is a razor cartridge configured to be releasably attached to a razor handle;

at least one of the razor cartridge or the slot includes a snap-fit configuration so that the razor cartridge is snap-fitted into the slot, the razor blade is configured to span the gap to electrically connect the first electrically conductive element and the second electrically conductive element;

the first and second electrically conductive elements are first and second pins at least partially provided in the slot;

the razor blade contacts the first and second pins in the closed position;

the at least one controller is configured to detect removal of a first razor cartridge from a first slot when the electrical circuit is in the open configuration;

the at least one controller is configured to detect placement of the first razor cartridge back into the first slot when the electrical circuit is in the closed configuration;

the at least one controller includes a microcontroller configured to generate a current and measure at least one of the current or a voltage difference;

the memory is configured to store a number of times the electrical circuit is in the opened configuration and a number of times the electrical circuit is in the closed configuration;

the at least one controller is configured to determine shaving information, the shaving information including at least one of:

how frequently a user shaves, a number of shaves for which the user may use a particular razor cartridge among the at least one razor cartridge, a duration of each shave, or a number of used or unused razor cartridges based on a presence or absence of a protective film on each razor cartridge among the at least one razor cartridge;

the display is configured to provide at least one of shaving advice or usage advice to the user; and the communication unit is configured to transmit, based on the determined shaving information, at least one of:

a notification to the display, a notification to a remote device of the user, or a purchase order to a merchant device to purchase a new dispenser or a new razor cartridge.

11. A shaving system, comprising:

a dispenser including a plurality of slots configured to releasably receive a plurality of cartridges, respectively, each slot being configured to releasably receive a given cartridge of the plurality of cartridges, each cartridge including at least one blade and a protective film, and at least one controller, the at least one controller being configured to:

detect a removal of one of the plurality of cartridges from a corresponding slot of the plurality of slots, in response to detecting the removal, generate a signal for transmission to a third party, detect placement of a removed cartridge back into the corresponding slot, collect shaving information based on the detected removal and detected placement of the removed cartridge, determine a presence or absence of the protective film, and determine a number of unused cartridges based on the determined presence or absence of the protective film.

12. The system of claim 11, wherein:

each slot includes at least one conductive element and each cartridge includes a corresponding conductive element, the at least one conductive element being configured to engage the corresponding conductive, and the at least one controller is configured to detect the removal and the placement of the removed cartridge from the corresponding slot by detecting when the at least one conductive element disengages from the corresponding conductive element on the removed cartridge.

13. The system of claim 12, further comprising at least one electrical circuit configured to switch between an open configuration and a closed configuration, wherein:

the corresponding conductive element includes at least one of the blade or a conductive blade securing element configured to secure the at least one blade to one of the plurality of cartridges, and engagement of the at least one conductive element and the corresponding conductive element closes the electrical circuit, and disengagement of the at least one conductive element and the corresponding conductive element opens the electrical circuit.

14. The system of claim 11, further comprising a docking station configured to receive the dispenser, the docking station including a display configured to provide shaving or usage advice to a user, wherein the shaving information includes shaving frequency or shaving duration.

15. A shaving system, comprising:

a razor cartridge having at least one conductive razor blade, the razor cartridge being configured to be releasably attached to a razor handle;

a dispenser including a plurality of slots, each slot configured to releasably receive the razor cartridge; and a controller, wherein:

a conductive element is at least partially provided in each slot, the razor cartridge includes a corresponding conductive element, the corresponding conductive element including the conductive razor blade, the conductive element is configured to contact the corresponding conductive element to close an electric circuit, and the controller is configured to determine a removal of the razor cartridge from the dispenser when the electric circuit is opened.

16. The shaving system of claim 15, further comprising a docking station configured to receive the dispenser and including the conductive element.

* * * * *